United States Patent [19]

Conti

[11] 4,170,350

[45] Oct. 9, 1979

[54] MAIL HANDLING APPARATUS

[75] Inventor: Joseph A. Conti, Whitestone, N.Y.

[73] Assignee: Pitney-Bowes, Inc., Stamford, Conn.

[21] Appl. No.: 863,928

[22] Filed: Dec. 23, 1977

[51] Int. Cl.[2] ..... B65H 5/06

[52] U.S. Cl. ..... 271/274; 101/232; 188/71.2; 192/12 B

[58] Field of Search ..... 271/274, 273, 122, 124, 271/125, 35, 272, 121, 80; 198/782; 188/71.2, 82.9; 226/187; 101/232; 192/12 B

[56] References Cited

U.S. PATENT DOCUMENTS

| | | | |
|---|---|---|---|
| 2,302,060 | 11/1942 | Ryan | 271/274 |
| 3,754,754 | 8/1973 | Peterson | 271/125 X |

*Primary Examiner*—Bruce H. Stoner, Jr.
*Attorney, Agent, or Firm*—Peter Vrahotes; William D. Soltow, Jr.; Albert W. Scribner

[57] ABSTRACT

A noise and impact reduction arrangement for a mail handling system wherein successive mail pieces of varying thicknesses may be fed to and through a mail processing work station in an efficient and rapid manner. The arrangement includes a feed assembly which is associated with the work station and which is adapted to be yieldably biased to a normal operative position and to be deflected away from said position to varying extents depending on the thickness of the various mail pieces that are successively fed through said station. Such deflection away from said normal position is readily permitted but a drag or braking force is applied to the feed assembly during its return movement towards said normal position so as to greatly reduce the severe arresting noise and shock that would otherwise be generated by the feed assembly reaching its said normal position.

3 Claims, 6 Drawing Figures

MAIL HANDLING APPARATUS

BACKGROUND OF THE INVENTION

As the demand for increased performance of mail handling equipment is implemented, machine refinements are required which can accommodate and control both the faster moving mail pieces and the higher accelerations and decelerations of the machine components involved. Transport means for mail pieces and other documents of varying thicknesses have been previously devised, however one of the difficulties arising out of the use of such transport means is that as the operating speeds thereof are increased the noise and shock generated by certain portions of the varying thickness document transport means increase to objectionably high levels. These factors have to varying extents heretofore effectively limited the cyclic speeds at which mail handling apparatus may effectively operate.

SUMMARY OF THE INVENTION

The present invention contemplates the provision of a means for controlling the movement of a portion of a movable letter feed assembly, such portion being yieldably biased to a normal position from which it may deflect through distances corresponding to the respective thicknesses of the mail pieces passing thereby. After passage of each mail piece past said feed assembly the return motion of the latter to its said normal position is adapted to be damped or braked so that each successive arrival of said assembly at said normal position may occur in a smooth and quiet manner even during relatively high speed operations of the associated mail handling equipment.

The primary object of the invention is to provide an efficient low cost motion damping or braking means for controlling the spring biased return movement of movable mail handling feed assembly to its normal position.

Other objects of the invention will become apparent as the disclosure progresses.

DETAILED DESCRIPTION OF THE INVENTION

Figure 1:
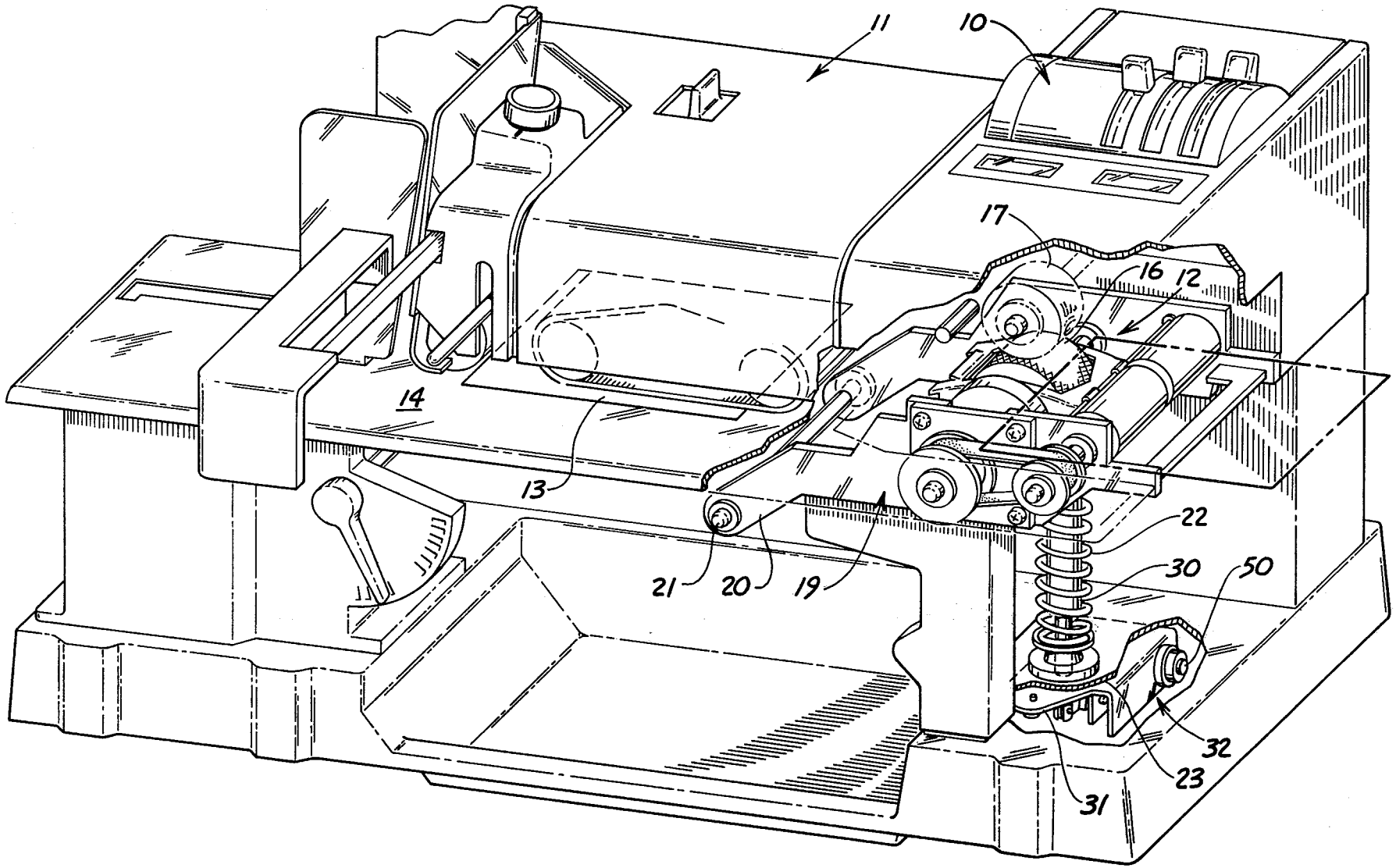
FIG. 1 is a perspective view illustrating a mail piece handling environment in which the present invention is embodied.
Figure 2:
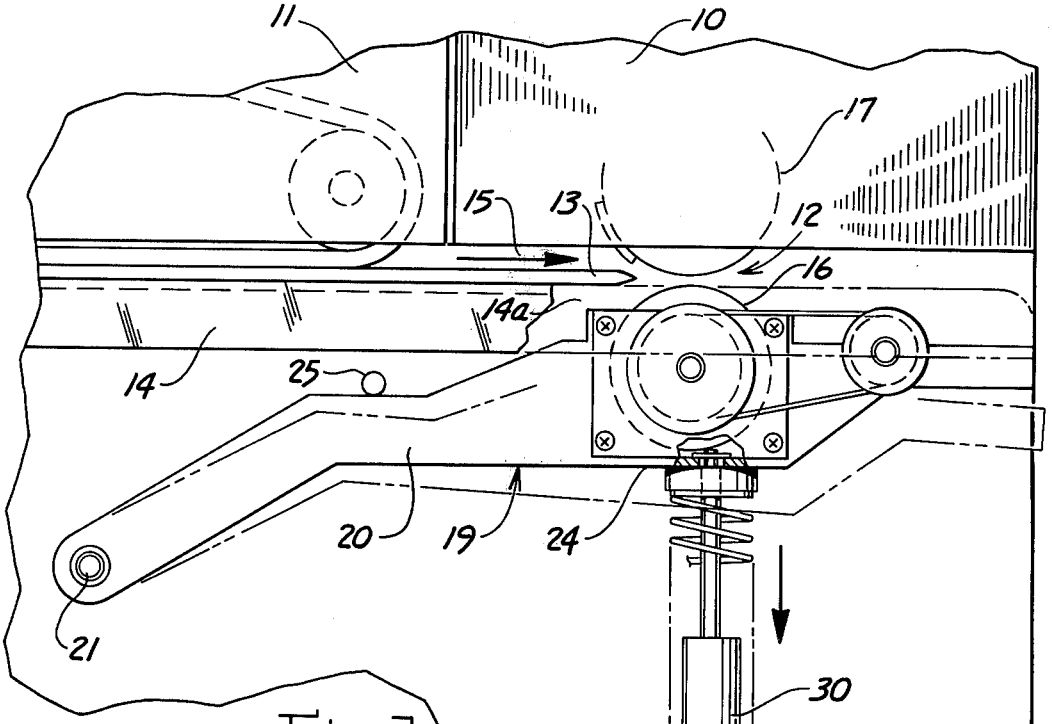
FIG. 2 is a front elevational view of a portion of the apparatus of FIG. 1 and illustrates the normal upper position for the mail piece feed and pressure assembly.

Referring to FIGS. 1 and 2 there is shown a particular mechanical environment for the present invention, namely a postage meter 10 that is operatively mounted on a mailing machine 11; this general combination being conventional in nature and being commercially available from Pitney-Bowes, Inc. of Stamford, Conn. This apparatus, part of which defines a postal indicia print work station 12, is adapted to transport successive letters such as 13 along a feed deck 14 and through the said work station 12 as indicated by arrow 15 of FIG. 2. The mailing machine 11 includes a mail piece handling assembly 19 which is defined by an impression roller 16 that is disposed in an aperture **14*a*, FIG. 2, of the feed deck 14 and in cooperative relation with respect to the adjacent peripheral portion of the rotary printing drum 17 of the postage meter 10. The impression roller 16 is adapted to yieldably press each successive letter moving through work station 12 into print receiving engagement with periphery of the postage meter printing drum 17 so that each letter may receive the desired postal indicia imprint in passing through said work station. In that the axis of the print drum 17 is essentially fixed the roller 16 must be movably mounted in the mailing machine 11 so as to permit said roller to be yieldably deflected slightly away from the drum 17 in order that letters or other mail pieces of varying thickness may be effectively accommodated during passage thereof through the work station 12. To this end assembly 19 includes a bracket 20 which rotatably carries said roller 16 and which is pivotally mounted as at 21 on the frame of the mailing machine 11. The bracket 20 is yieldably biased upwardly as seen in FIGS. 1 and 2 by means of a compression spring 22 that is operatively disposed between a lower portion 23, FIG. 2, of the mailing machine frame and the lower portion 24 of the outer end of the impression roller bracket 20. The normal position of bracket 20 is determined by engagement of said bracket with any suitable stop means, such as 25 of FIG. 2, carried by the mailing machine frame; such normal position being indicated by the bracket solid line position of FIG. 2. This normal bracket position is such that roller 16 is disposed so as to be very close to but not quite touching the non printing areas of said printing drum 17 as is understood in the art. As will be apparent from the apparatus described above mail pieces of varying thicknesses will be accommodated at the work station 12 by reason of the impression roller 16 being capable of yieldably moving away from and towards the periphery of the printing drum 17**. The general structural and functional arrangement described above is conventional in nature and thus needs no further description here.

Figure 3:
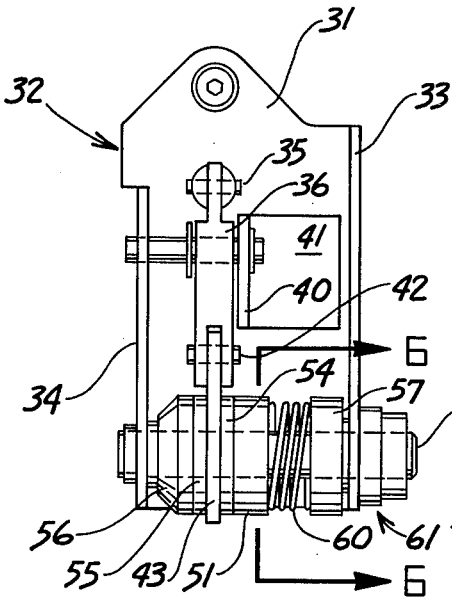
FIG. 3 is a bottom view of some of the apparatus shown in FIG. 2, as seen along the view line 3—3 of FIG. 2.
Figure 6:
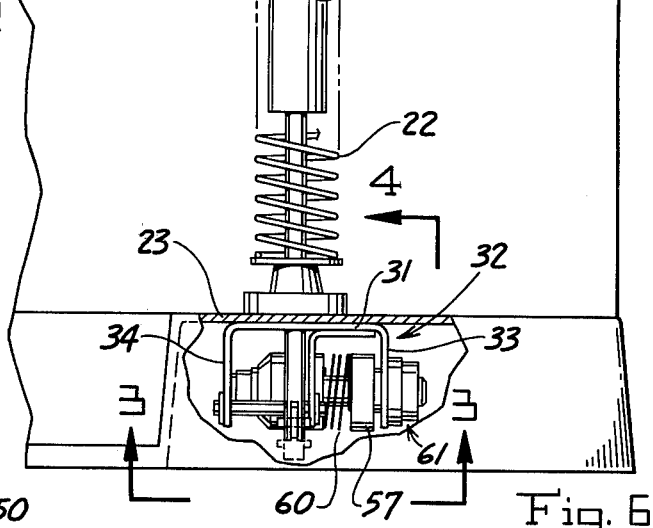
FIG. 6 is a sectional view taken along section line 6—6 of FIG. 3.
Figure 4:
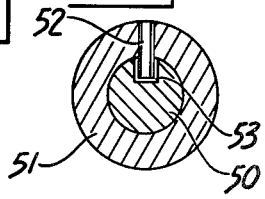
FIG. 4 is a broken away side elevational view taken along section line 4—4 of FIG. 2 and shows the illustrated parts in their respective normal positions.
Figure 4:
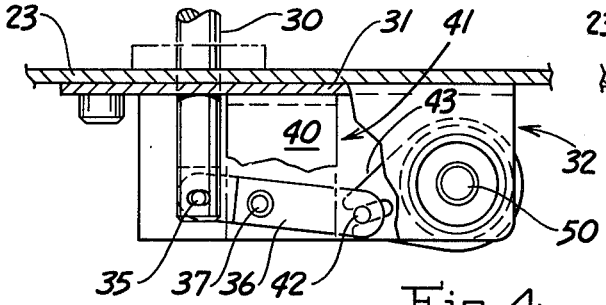

In that spring 22 has to be fairly strong to produce the required printing operation of the drum 17 this spring force will produce a substantial level of shock and noise by reason of the impression bracket 20 being driven upwardly against the said normal position stop 25 after each mail piece passes through the work station 12. The present invention is concerned with eliminating or substantially reducing such shock and noise and to this end a damper or braking means is provided for yieldably restraining the return movement of the bracket 20 towards its said normal position. Coupled to and depending from said lower portion 24, FIG. 2, of the outer end of bracket 20 is a rod member 30 that extends downwardly through spring 22 and through coaxial apertures respectively formed in said lower frame portion 23 and the body portion 31 of a U-shaped bracket 32. The bracket 32 is fixed by any suitable means to said frame portion 23 and has integrally formed thereon opposed depending arms 33, 34 as is best seen in FIGS. 2–4. The lower end of rod member 30 is pivotally connected by means of a suitable pin 35, FIGS. 3 and 4, to a lever 36, the latter being pivotally mounted by means of a suitable pin 37 on the vertically disposed leg 40 of a right-angle bracket 41, FIGS. 3 and 4, that is fixedly secured by any suitable means to the lower side of the said body portion 31 of bracket 32. The right hand end of lever 36, as seen in FIG. 4, is slotted in the manner shown in FIG. 3 and carries a pin 42 that is embraced by the slotted outer end of a lever 43, FIG. 4, that is rotatably carried by a shaft 50. Shaft 50 is rotatably mounted on and between the said depending arms 33 and 34 of bracket 32. A pressure collar 51 is mounted on shaft 50, said collar having a pin 52, FIG. 6, fixably secured thereto which radially extends into a longitudinal groove 53 formed in said shaft as is best seen in FIG. 6; the collar 51 thus being rotatably secured to but axially movable relative to the shaft 50. Disposed on said shaft 50 between the adjacent faces of lever 43 and collar 51 is an annular friction washer or pad 54. A similar friction pad or washer 55 is carried by shaft 50 and is disposed between the opposite faces of lever 43 and the adjacent face of a second collar 56 that is fixedly secured on said shaft 50. Shaft 50 also has fixedly mounted thereon a third collar 57. A compression spring 60 is operatively disposed between the collar 57 and the axially movable collar 51 so that the latter will be biased by spring 60 to the left as seen in FIG. 3 whereby the lever 43 will be yieldably frictionally gripped by and between the two opposed friction pads 54 and 55.

An overrunning or one-way clutch 61 is operatively mounted on the right hand end, as seen in FIG. 3, of shaft 50; the outer or output portion of said clutch being secured to the adjacent bracket arm 33 while the inner or input portion of said clutch is secured to said shaft 50. In that the construction and operation of clutch 61 is conventional in nature (such may for example comprise a drawn up roller #RC-061008 as is now commercially available from the Torrington Manufacturing Company of Torrington, Conn.) no further description of the details of said one-way clutch 61 is necessary here other than to indicate that such clutch will permit rotation of shaft 50 in a clockwise direction as indicated by arrow 62 of FIG. 5, but will prevent rotation of shaft 50 in the opposite direction.

Figure 5:
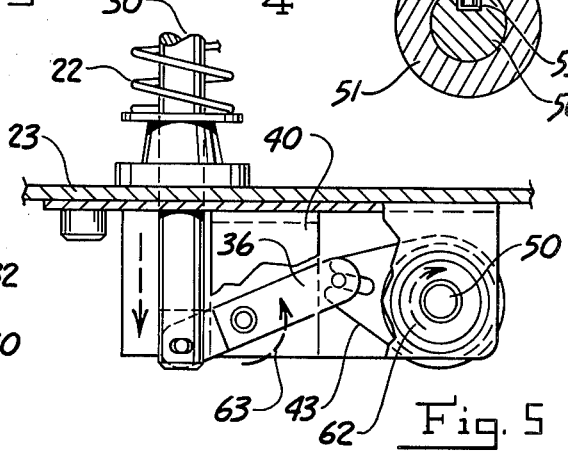
FIG. 5 is a side elevational view corresponding to FIG. 4 and shows the movable parts of FIG. 4 in their respective actuated positions.

As will now be apparent lever 43 may be pivoted in a clockwise direction, as seen in FIG. 5, whereby shaft 50 will be idly driven in said clockwise direction, however when lever 43 is swung in the opposite direction by the action of spring 22 clutch 61 will prevent shaft 50 from rotating in said opposite direction so that rotational frictional slippage will occur between said lever 43 and said friction collars 54 and 55; this slippage affording a braking action to said opposite or counter clockwise motion of lever 43. The spring 60 and its effective degree of compression are selected so as to produce the desired level of said yieldable friction braking action accompanying the said counter clockwise motion of lever 43.

In the operation of the above described apparatus when the mail handling assembly 19 is displaced downwardly, i.e., in a clockwise direction as seen in FIG. 2, by reason of a letter being fed through the work station 12 the resultant downward movement of rod member 30 will cause lever 36 to swing in a counter-clockwise direction as indicated by arrow 63 of FIG. 5 whereby the lever 43 will be driven in a clockwise direction as indicated by said arrow 62 of FIG. 5. Lever 43 will thus idly displace the shaft 50 in a clockwise direction with no slippage between lever 43 and friction pads 54, 55. When however the mail piece is printed on and leaves the work station 12 the resultant upward movement of the assembly 19 caused by the action of spring 22 will be retarded because the shaft 50 can not be driven in a counter clockwise direction, as seen in FIG. 4, and the resultant braking or drag slippage between lever 43 and said friction pads 54, 55 will generate a braking force sufficient to produce the desired speed of return of said impression roll bracket 20 to its said normal position. This desired speed of return is adjusted so as to reduce the said shock and noise to the minimum possible level consistent with the speed of operations desired.

The above described one-way yieldable braking apparatus has been found to be particularly beneficial in reducing the level of noise and shock generated during rapid cycling of mail processing equipment.

What is claimed is:

1. In a mail handling apparatus having a work station and including:

a mail piece handling assembly pivotably supported in said apparatus;

means for movably supporting said assembly whereby said assembly may be displaced in accordance with the varying thicknesses of the respective mail pieces moving to and through said work station; and biasing means for yieldably maintaining said assembly in a normal position:

the improvement comprising:

one-way braking means including a shaft, a one-way clutch mounted on said shaft for permitting rotary movement of said shaft in one direction only relative to said clutch, and a coupling yieldably connecting said shaft to said support means, such that when mail pieces are fed into said work station said assembly may yieldably deflect away from its normal position and rotate said shaft unrestrained by said braking means but will be braked by said one-way clutch and yieldable coupling in moving back towards said normal position thereby minimizing the shock and noise generated by the restoration of said mail handling assembly to its said normal position.

2. Apparatus as defined by claim 1 wherein said one-way clutch prevents rotary movement of said shaft in one direction.

3. Apparatus as defined by claim 1 wherein said yieldable coupling includes a lever rotatably carried on said shaft and rotary friction means disposed upon said shaft to yieldably retard movement of said feed assembly towards its said normal position.

* * * * *